US005476038A

United States Patent [19]

Fuwa et al.

[11] Patent Number: 5,476,038

[45] Date of Patent: Dec. 19, 1995

[54] STAMP APPARATUS

[75] Inventors: Tetsuji Fuwa, Hashima; Keiji Seo, Nagoya, both of Japan

[73] Assignee: Brother Kogyo Kabushiki Kaisha, Nagoya, Japan

[21] Appl. No.: 138,025

[22] Filed: Oct. 19, 1993

[30] Foreign Application Priority Data

Feb. 2, 1993 [JP] Japan ..... 5-015525
Mar. 1, 1993 [JP] Japan ..... 5-007841 U

[51] Int. Cl.[6] ..... B41F 15/00

[52] U.S. Cl. ..... 101/114; 101/127.1

[58] Field of Search ..... 101/114, 127, 101/127.1, 125, 126, 128, 128.21, 121

[56] References Cited

U.S. PATENT DOCUMENTS 3,585,928 6/1971 Kaneko ..... 101/477
4,628,813 12/1986 Hasegawa et al. ..... 101/116
5,184,549 2/1993 Imamaki et al. ..... 101/128.21
5,241,187 8/1993 Ikeda et al. ..... 101/114
5,253,581 10/1993 Miki et al. ..... 101/127.1
5,285,725 2/1994 Imamaki et al. ..... 101/127.1

FOREIGN PATENT DOCUMENTS 0813620 5/1969 Canada ..... 101/127
4-332645 11/1992 Japan .

*Primary Examiner*—Edgar S. Burr
*Assistant Examiner*—Anthony H. Nguyen
*Attorney, Agent, or Firm*—Oliff & Berridge

[57] ABSTRACT

A stamp apparatus prevents a used stencil plate from being used again for making a plate. The apparatus includes a reflective photo sensor that determines if thermal paper of the currently set stencil plate is colored from a past plate-making process. On detecting the colored thermal paper, the sensor prompts an LCD to give an alarm display warning the user of the used stencil plate. Alternatively, a retractable projection interferes with insertion of a used stencil plate. In both cases, the stamp apparatus remains disabled until the used stencil plate is removed. This protects the stamp apparatus from getting soiled or damaged by spilled ink from the used stencil plate set inadvertently by the user.

28 Claims, 14 Drawing Sheets

Fig.7B

| ITEM | INSTRUCTIONS |
|---|---|
| S11 | SCAN KEYS |
| S12 | CHARACTER INPUT ? |
| S13 | PERFORM DATA INPUT PROCESSING |
| S14 | DISPLAY INPUT CHARACTER ON LCD |
| S15 | PLATE-MAKING KEY PUSHED ? |
| S16 | STENCIL PLATE SET ? |
| S17 | SET PLATE-MAKING FLAG TO 1 |
| S18 | SET No. OF LINES TO BE PERFORATED |
| S19 | PRESS THERMAL HEAD AGAINST STENCIL PLATE |
| S20 | THERMAL PAPER COLORED ? |
| S21 | DISPLAY ALARM MESSAGE WARNING REUSE OF ALREADY USED PLATE |
| S22 | USED PLATE STILL IN PLACE ? |
| S23 | CANCEL ALARM |
| S24 | PERFORATE ONE LINE |
| S25 | PROMPT USER TO SET STENCIL PLATE |
| S26 | DECREMENT LINE COUNT BY 1 |
| S27 | LINE COUNT = 0 ? |
| S28 | SET PLATE-MAKING FLAG TO 0 |
| S40 | OTHER PROCESS |

STAMP APPARATUS

BACKGROUND OF THE INVENTION

1. Field of the Invention

The present invention relates to a stamp apparatus. More particularly, the invention relates to a stamp apparatus for preventing a used stencil plate from being reused in plate making.

2. Description of Related Art

FIG. 14 shows a conventional press type mimeograph machine that uses thermal stencil paper perforated by infrared radiation or by heat application from a thermal head. Thermal stencil paper 300 used on this machine is made of a thermoplastic film glued on a porous base material, the latter being surrounded by a frame 302. The frame 302 and an ink-impervious cover sheet 304 combine to form an engraved portion 314 to which ink is applied. The thermal stencil paper 300, frame 302, cover sheet 304 and engraved portion 314 constitute a thermal stencil plate 306.

The mimeograph machine comprises a press member 308, a cradle 310 opposed to the press member 308, and a retaining member 312 for retaining the thermal stencil plate 306. The retaining member 312 is located around the periphery of that part of the press member 308 that faces the cradle 310.

For the above mimeograph machine to operate, the thermal stencil paper 300 of the stencil plate 306 is first perforated by the thermal head of a plate-making mechanism of the machine. Ink is applied to the engraved portion 314 within the frame 302 of the thermal stencil plate 306. Then, the cover sheet 304 is placed onto the engraved portion 314 with the frame 302 held therebetween, and the thermal stencil plate 306 is retained by the retaining member 312 against the press member 308. The press member 308 is pressed onto the cradle 310 with printing paper 316 placed therebetween. The pressing action forces the ink through the perforations of the thermal stencil paper 300 onto the printing paper 316 for printing thereon.

One disadvantage of the above prior art machine is that the user is required to apply ink manually to the stencil plate. In doing so, the user tends to get dirty hands or smeared clothes. In addition, irregular application of ink by an inexperienced user can result in uneven densities in printing.

Another disadvantage of the prior art machine is that the user can inadvertently set thermal stencil paper 300 already used onto the plate-making mechanism of the machine for making another plate. This can lead to many problems including the plate not being perforated appropriately, the ink residue on the thermal stencil paper 300 sticking to heat-generating parts on the thermal head, and/or ink being trapped in the plate-making mechanism.

SUMMARY OF THE INVENTION

It is therefore an object of the present invention to overcome the above and other deficiencies and disadvantages of the prior art and to provide a stamp apparatus that prevents a used stencil plate from being used again for making a plate.

A stamp apparatus of the invention comprises an input mechanism for inputting data concerning an image, a thermal stenciling sheet having a substrate, an ink supplying mechanism provided on the substrate, and thermal stencil paper provided on the ink supplying mechanism. A thermal head mechanism forms pores by the application of heat in the thermal stenciling sheet according to the data input by the input mechanism. A preventing mechanism provided on one of the stamp device and the thermal stenciling sheet prevents the pores from being formed on the thermal stencil paper where the pores have been already formed.

As outlined above, the preventing mechanism makes it possible to prevent any used thermal stencil plate from getting inadvertently perforated again in plate making. As a result, the plate-making mechanism will not be smeared or damaged by ink.

Other objects, features and advantages of the present invention will become apparent in the following specification and accompanying drawings.

BRIEF DESCRIPTION OF THE DRAWINGS

Preferred embodiments of the present invention will be described in detail with reference to the following figures, wherein:

FIGS. 7A and 7B are a flowchart of steps and a chart therefor, respectively, of a main program in the first embodiment;

DETAILED DESCRIPTION OF PREFERRED EMBODIMENTS

Figure 12:
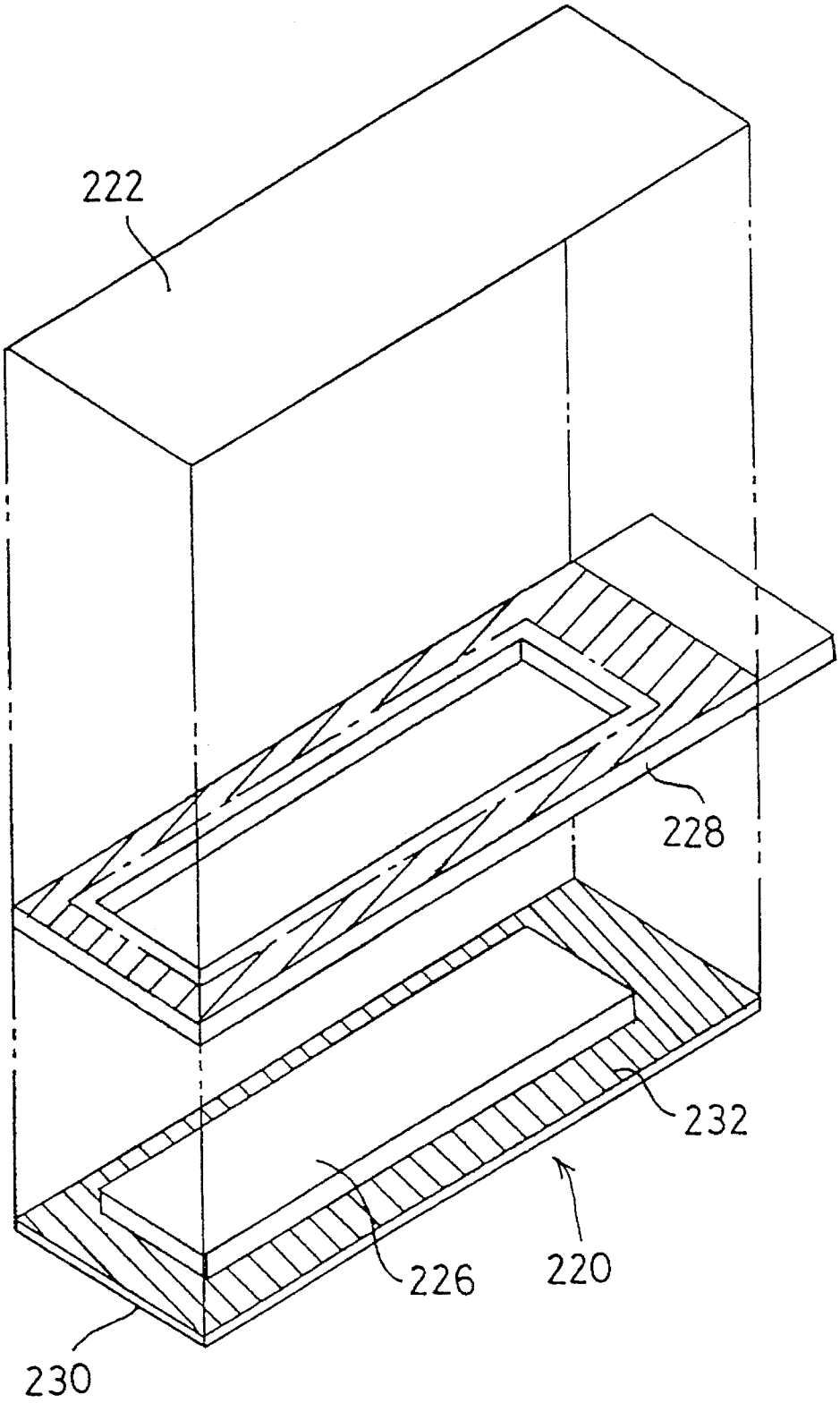
Fig.12 RELATED ART
FIG. 12 is an exploded perspective view of a stencil plate in the related art.
Figure 13:
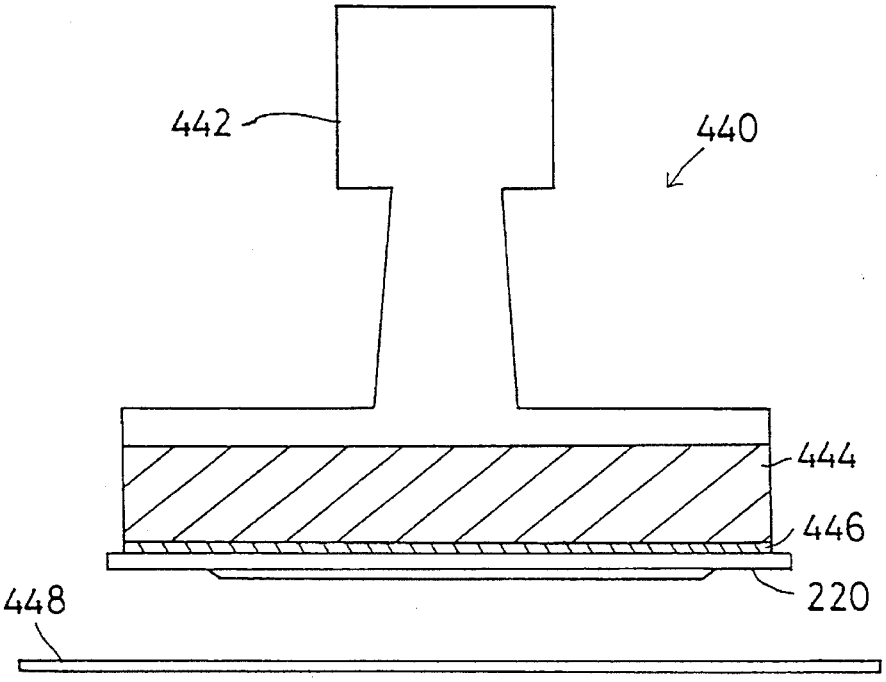
Fig.13 RELATED ART
FIG. 13 is a side view of a stamping member in the related art.
Figure 14:
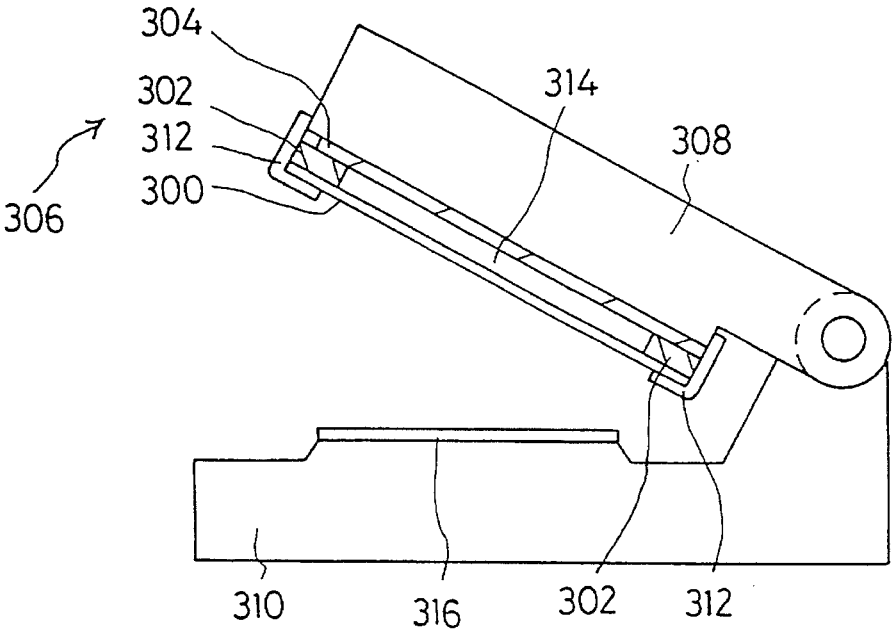
Fig.14 RELATED ART
FIG. 14 is a schematic view of a typical press type mimeograph machine of the related art.

FIGS. 12 and 13 show a typical stencil plate of the related art. In FIGS. 12 and 13, a stencil plate 220 comprises a thermoplastic film deposited on thermal stencil paper 222. In making the plate, a stamp apparatus using a thermal head thermally perforates the thermoplastic film to form a perforated image thereon. The stencil plate 220 thus prepared is mounted on a stamping member 440 having a grip 442. The stamping member 440 comprises the grip 442, a cushion layer 444 and an adhesive layer 446. With the stencil plate 220 attached to the adhesive layer 446, the stamping member 440 is pressed against printing paper 448. The pressing action compresses non-woven fabric 226 so that the ink impregnated therein is forced through the perforations of the stencil paper 222 onto the printing paper 448 for printing.

One disadvantage of the above related art arrangement is that the user may inadvertently set a used stencil plate 220 on the stamp apparatus and that the apparatus will accept the used plate without detecting anything unusual. This leads not only to the preparation of an inappropriately perforated plate but also to other diverse irregularities such as a peeled thermoplastic film sticking to the heat-generating parts of the thermal head, the ink forced out of the non-woven fabric 226 through the previous perforations to smear the thermal head, or the ink dripping into the plate-making mechanism.

Figure 1:
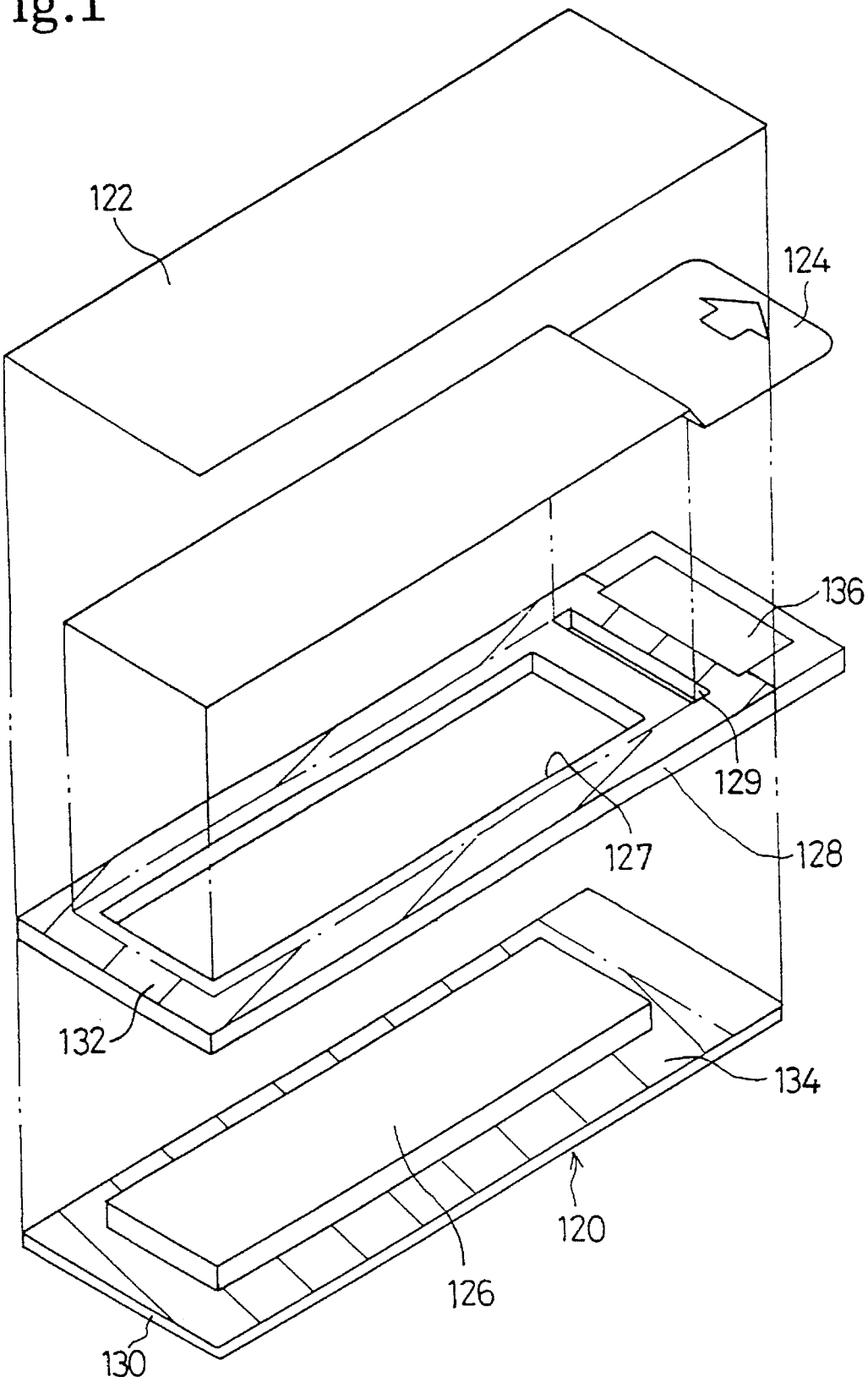
FIG. 1 is an exploded perspective view of a stencil plate in a first embodiment.

As opposed to the above related art arrangement, the first embodiment of the invention is described below. Referring to FIG. 1, a stencil plate 120 of the first embodiment is composed primarily of thermal stencil paper 122, a separator 124, ink-impregnated non-woven fabric 126, a frame 128 with an opening 127 and surrounding the non-woven fabric 126, and a film 130 that is an ink-impervious base material.

Figure 5:
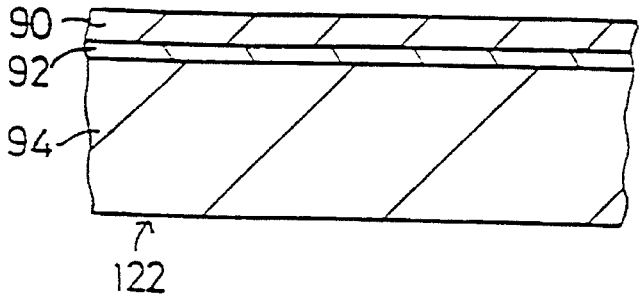
FIG. 5 is a partial cross-sectional view of thermal stencil paper in the first embodiment.

As shown in FIG. 5, the thermal stencil paper 122 is made of a thermoplastic film 90, an adhesive layer 92 and a porous base material 94. As part of the first embodiment, the thermoplastic film 90 is preferably a polyethylene terephthalate film (PET film) 2 μm in thickness. Alternatively, the film 90 may be any one of suitable films such as polypropylene film and vinylidene chloridevinyl chloride copolymer film.

The PET film is preferably from 1 μm to 4 μm in thickness. A PET film less than 1 μm thick is too expensive to manufacture and not strong enough to be practical. A PET film more than 4 μm in thickness is too thick to be perforated by most thermal heads with ratings of about 50 mj/mm$^2$. The porous base material 94 is preferably a thin porous paper sheet composed primarily of natural fibers (e.g., Manila hemp, kozo, mitsumata), synthetic fibers (e.g., polyethylene terephthalate, polyvinyl alcohol, polyacrylonitrile) or semi-synthetic fibers (e.g., rayon).

The frame 128 has a central opening 127 that is the size of the non-woven fabric 126 and a rectangular slot 129 through which to extract the separator 124. Thermal paper 136 that is thermally colored is furnished beside the rectangular slot 129. The thermal paper 136 is located so that part of it overlaps with the thermal stencil paper 122. This arrangement is intended to let a thermal head 28, to be described later, travel over the thermal stencil paper 122 while perforating it and move smoothly into contact with the surface of the thermal paper 136.

The top surface of the frame 128 is coated with an adhesive layer 132 for gluing the thermal stencil paper 122 thereon. Because the ink impregnated in the non-woven fabric 126 is oil-based, the frame 128 is made of any material that is resistant to erosion by oil-based ink. Such materials include vinyl chloride, polypropylene, polyethylene, polyacetal and polyethylene terephthalate.

The non-woven fabric 126 is saturated with oil-based ink. Pressing the non-woven fabric 126 causes the ink to ooze out. The non-woven fabric 126 is preferably a synthetic fiber such as polyethylene, polypropylene or polyethylene terephthalate. The thickness of the non-woven fabric 126 is preferably no greater than three times that of the frame 128 and at least half thereof. An excessively thin non-woven fabric 126 can cause the thermal stencil paper 122 to sink into the frame 128 during the plate-making process. Deprived of its contact with the thermal head 28, the thermal stencil paper 122 cannot be perforated thereby. An inordinately thick non-woven fabric 126 is compressed by the thermal head 28, whereby the impregnated ink is forced out of the frame 128.

Under these irregular circumstances, the stencil plate 120 cannot be transported properly during the plate-making process. Where the non-woven fabric 126 is uneven in thickness, the stencil plate 120 may be transported at an irregular pitch or moved askew. The non-woven fabric 126 is preferably made so as to take on the same thickness as the frame 128 when compressed by the thermal head 28 during the plate-making process.

The separator 124 is furnished between the thermal stencil paper 122 and the non-woven fabric 126. An edge of the separator 124 is threaded through the rectangular slot 129 of the frame 128 and between the frame 128 and the film 130, and protrudes out of the stencil plate 120.

The opening 127, i.e., the space surrounded by the shaded frame 128 in FIG. 1, is an area where the non-woven fabric 126 is covered with the separator 124. The separator 124 may be any one of such materials as wood-free paper, silicon-treated glassine paper (parting agent-coated paper) and plastic resin film (e.g., polyethylene terephthalate, tetrafluoroethylene such as Teflon.) The principal property required of the separator 124 is a low degree of wettability with respect to oil-based ink. In specific terms, the wetting angle of the separator 124 is preferably 45 degrees or more. If wood-free paper is used, not only the surface that contacts with the non-woven fabric 126 but also both sides of the paper should preferably be treated with silicon. Where the paper has a high degree of wettability or if only one side of the paper is treated with silicon, ink may spread to reach the thermal stencil paper 122. This can result in ink seepage from the perforations as they are being made on the thermal stencil paper 122.

The film 130, an ink-impervious base material, is coated with the adhesive layer 134 on the top surface (shown shaded in FIG. 1) and is glued to the frame 128 and non-woven fabric 126. The film 130 is preferably a plastic resin film made of any one of such materials as vinyl chloride, polypropylene, polyethylene and polyethylene terephthalate, which are impervious to oil-based ink.

Figure 2:
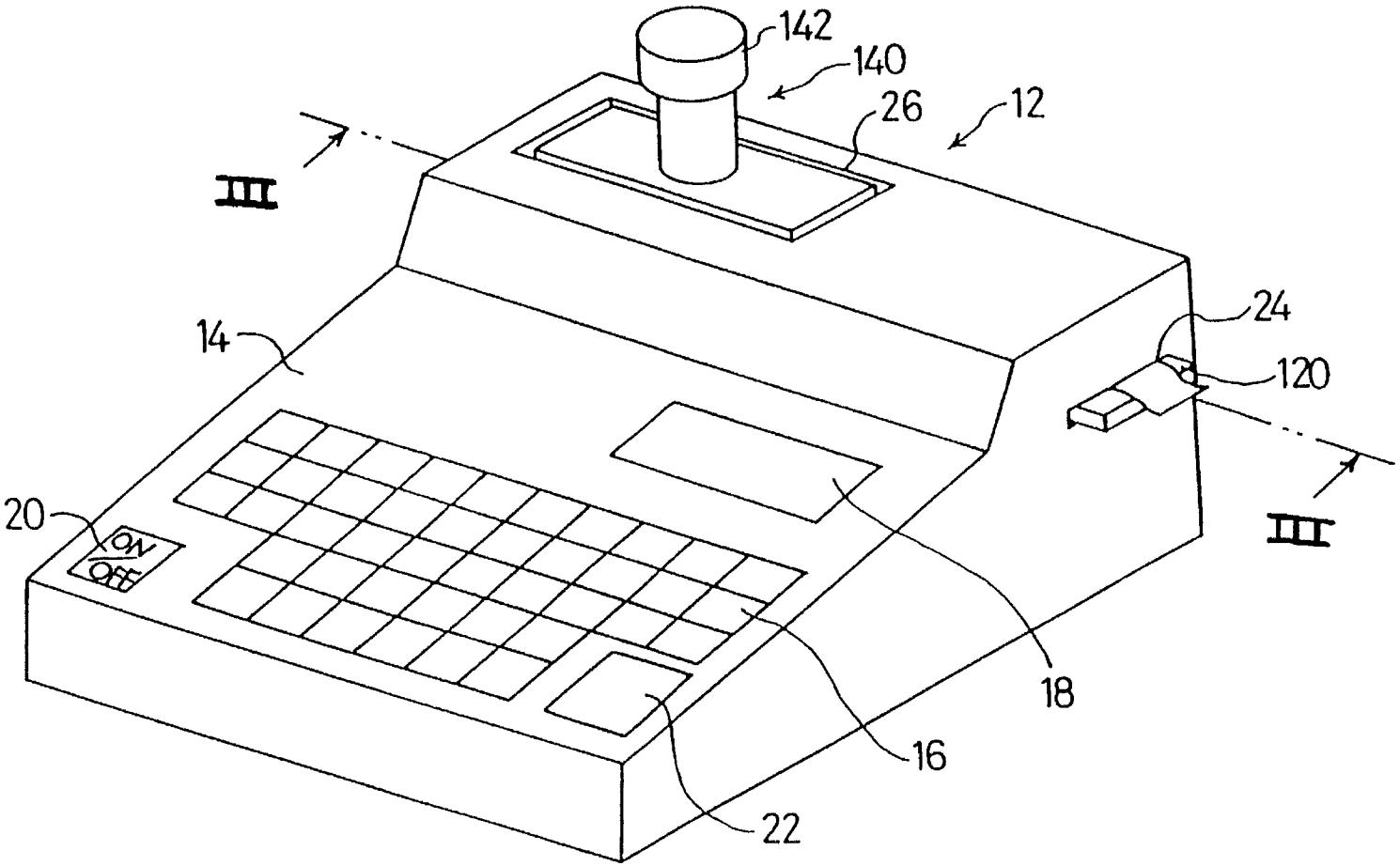
FIG. 2 is a perspective view of a stamp apparatus in the first embodiment.

FIG. 2 is a perspective view of a stamp apparatus 12 in the first embodiment according to the present invention. As illustrated, the stamp apparatus 12 has on its cover 14 a keyboard 16 through which to enter characters or functions, a liquid crystal display (LCD) 18 for displaying characters and other instructions entered from the keyboard 16, an ON/OFF key 20 for turning on and off power, and a plate-making key 22 for designating the making of a stencil plate. On top of a portion behind the cover 14 is a stamp groove 26 in which to place a stamp member 140. On a side of the cover 14 is an inlet port 24 to insert the stencil plate 120 into the apparatus for plate preparation.

Figure 3:
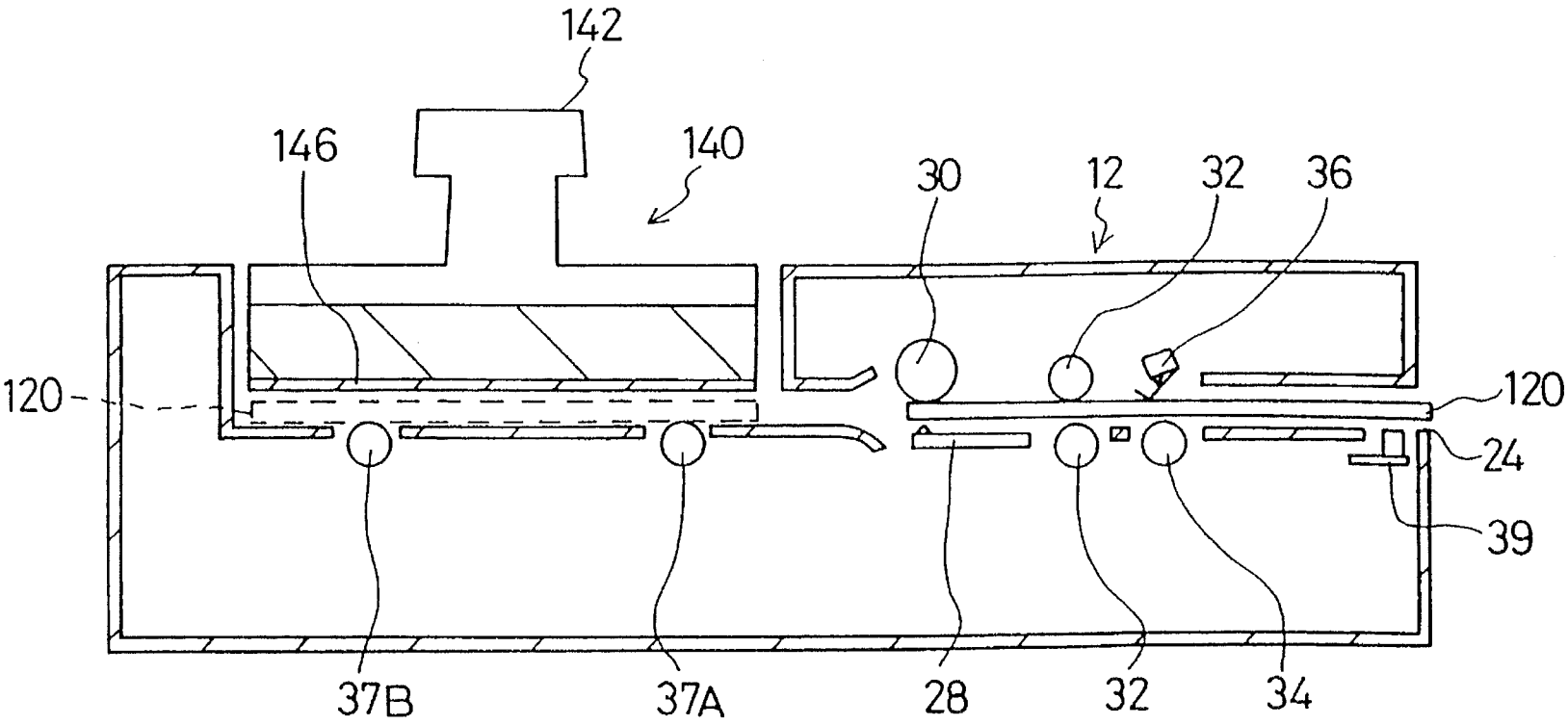
FIG. 3 is a cross-sectional schematic view of a plate-making mechanism in the first embodiment.

The plate-making mechanism of the stamp apparatus 12 is described with reference to FIG. 3, which is a cross-sectional view taken on line III—III in FIG. 2. The plate-making mechanism comprises a pair of feed rollers 32 for transporting the stencil plate 120 inserted from the inlet port 24, a plate detecting switch 36 for detecting the inserted stencil plate 120, a thermal head 28, a platen 30 facing the thermal head 28, and feed rollers 37A and 37B for feeding the stencil plate 120 perforated by the thermal head 28 toward the underside of the stamp member 140. Close to the inlet port 24 is a reflective photo sensor 39 for checking to see if thermal paper 136 attached to the stencil plate 120 is colored.

Figure 4A:
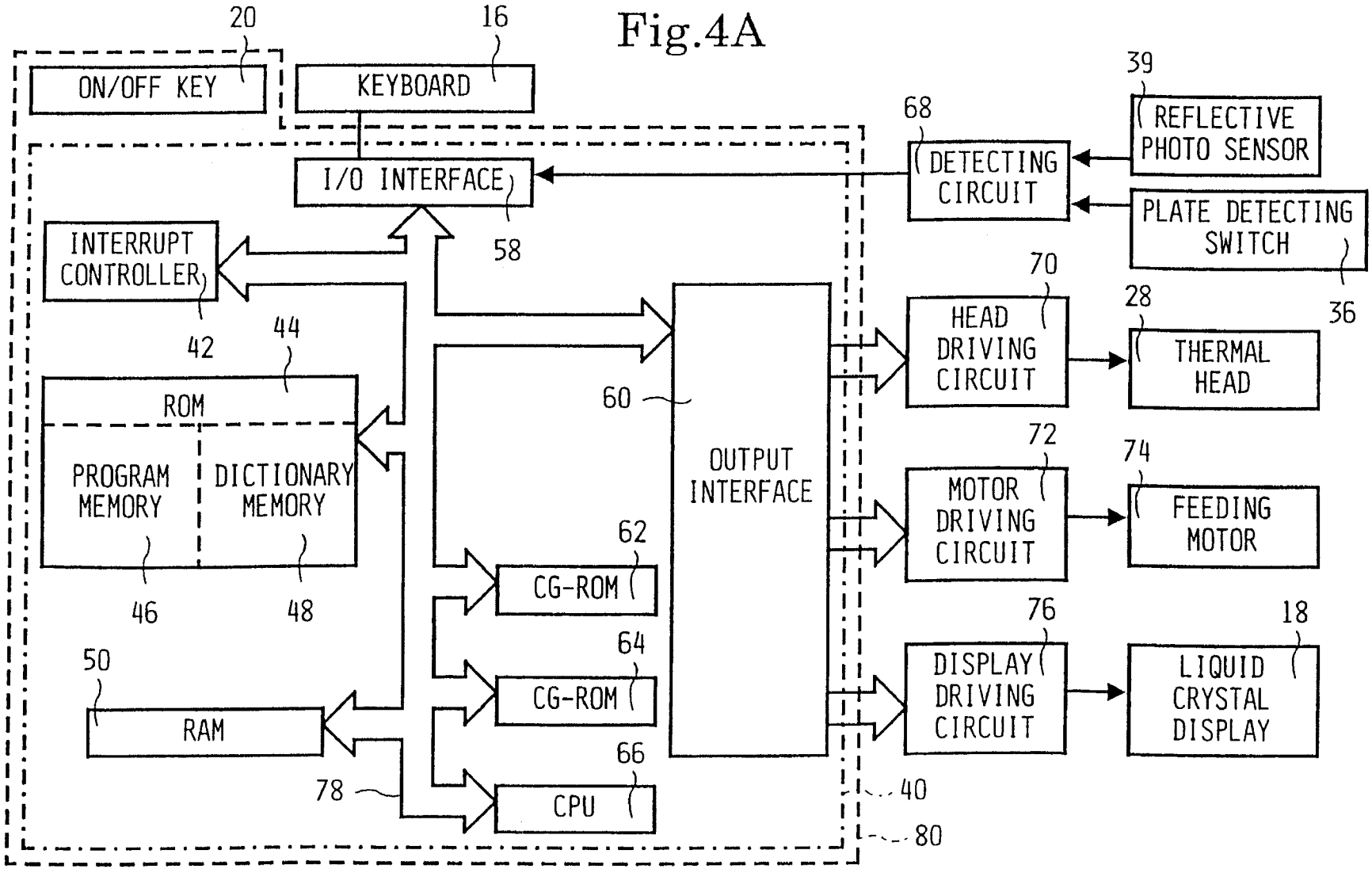
FIG. 4A is a block diagram of an electronic controller in the first embodiment.

The control system of the stamp apparatus 12 is described with reference to FIG. 4A, which is a block diagram of an electronic controller in the first embodiment. The keyboard 16 and a detecting circuit 68 are connected to an I/O interface 58 of a microcomputer 40. The detecting circuit 68 is connected to the plate detecting switch 36 for determining whether the stencil plate 120 is in position, as well as to the reflective photo sensor 39 for determining whether the thermal paper 136 is colored. The I/O interface 58 is connected via bus lines 78 to a CPU 66, a ROM 44, a RAM 50, a CGROM 62 for thermal perforation of the stencil plate 120, a CGROM 64 for activating the LCD 18, an output interface 60, and an interrupt controller 42 to handle the input of the ON/OFF key 20.

The ROM 44 includes a program memory 46 that stores programs for controlling the overall operation of the stamp apparatus 12 and a dictionary memory 48 containing dictionaries for character generation and conversion.

Figure 4B:
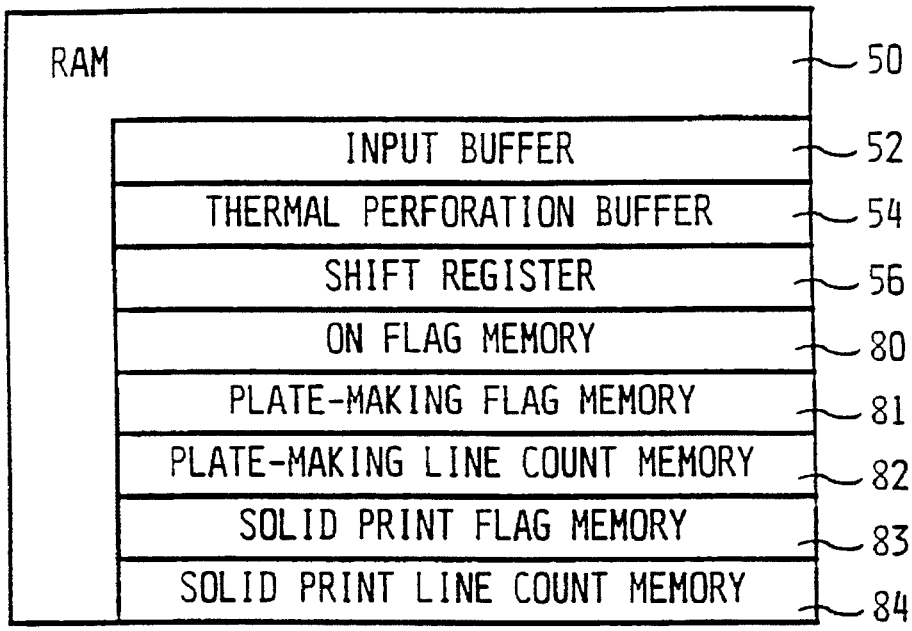
FIG. 4B is a block diagram of the RAM in the first embodiment.

The construction within the RAM 50 is described in detail with reference to FIG. 4B. The RAM 50 comprises an input buffer 52 that stores data entered from the keyboard 16, a thermal perforation buffer 54 that stores data for thermally perforating the stencil plate 12, a shift register 56 and other necessary counters and registers. The RAM 50 also includes an on-flag memory 80 with its flag indicating whether the stamp apparatus 12 is powered, a plate-making flag memory 81 with its flag indicating whether a plate-making process is to be performed, a plate-making line count memory 82 that stores the number of lines to be perforated on the stencil plate, a solid print flag memory 83 with its flag indicating whether solid printing is to be performed, and a solid print line count memory 84 that stores the number of lines to be printed solid.

The CGROM 62 for thermal perforation is used to generate dot patterns based on the code data representing the characters entered. The display CGROM 64 serves to generate dot patterns to be displayed on the LCD 18.

The output interface 60 is connected to a head driving circuit 70, a motor driving circuit 72 and a display driving circuit 76. The three circuits are connected, respectively, to the thermal head 28, a feeding motor 74 and the LCD 18. A power backup unit 80, incorporating the ON/OFF key 20 and microcomputer 40, is always powered and remains active. The other components outside the power backup unit 80 are turned on and off as needed to minimize power dissipation.

The plate-making process takes place as follows: the stencil plate 120 is first inserted through the inlet portion 24 into the apparatus. The stencil plate 120 is fed by the feed rollers 32 to a position where the tip of the plate faces the platen 30. There, the stencil plate 120 is stopped by a stopper and held in place. A retaining roller 34 retains the stencil plate 120 in such a position that the plate pushes and turns on the plate detecting switch 36. In that state, pressing the plate-making key 22 pushes the thermal head 28 against the platen 30 to pinch the stencil plate 120 therebetween.

Thereafter, the feeding motor 74 rotates the platen 30 so that the stencil plate 120 moves on as pressed against the thermal head 28. When the stencil plate 120 reaches a predetermined position, the thermal head 28 is driven to heat up based on the plate-making data edited according to previously entered character strings. On the stencil plate 120, one line is perforated every time the feeding motor 74 is rotated by one step.

When the thermal stencil paper 122 has been perforated, the thermal paper 136 attached to the stencil plate 120 reaches the position of contact with the thermal head 28. In that position, the thermal paper 136 turns to black under heat from the thermal head 28.

Upon completion of the above steps, the thermal head 28 is retracted from the stencil plate 120. The feed rollers 37A and 37B rotate to forward the stencil plate 120 to the position indicated by broken lines in FIG. 3, where the plate 120 stops. This completes the plate-making process.

At this stopping point, the stencil plate 120 comes immediately under the stamp member 140. In this state, pushing a grip 142 of the stamp member 140 glues an adhesive layer 146 onto the film 130 of the stencil plate 120. Now, the stencil plate 120 has been attached to the stamp member 140. With the stencil plate 120 thus mounted, the stamp member 140 is pushed against printing paper. The pushing action compresses the non-woven fabric 126 to force the impregnated ink therein through the perforations of the stencil paper onto the printing paper for printing.

Figure 6:
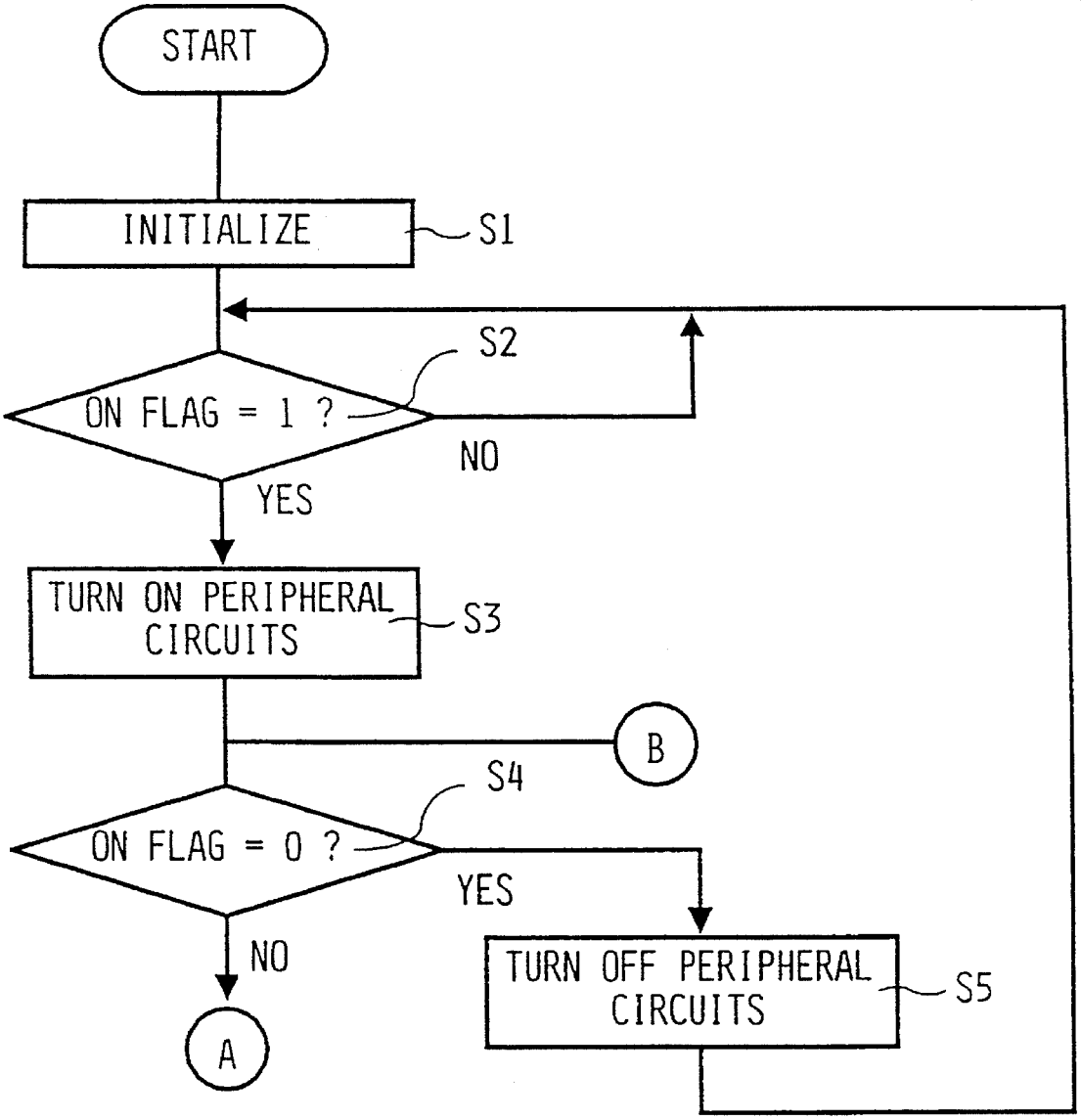
FIG. 6 is a flowchart of steps for turning power on and off in the first embodiment.
Figure 7A:
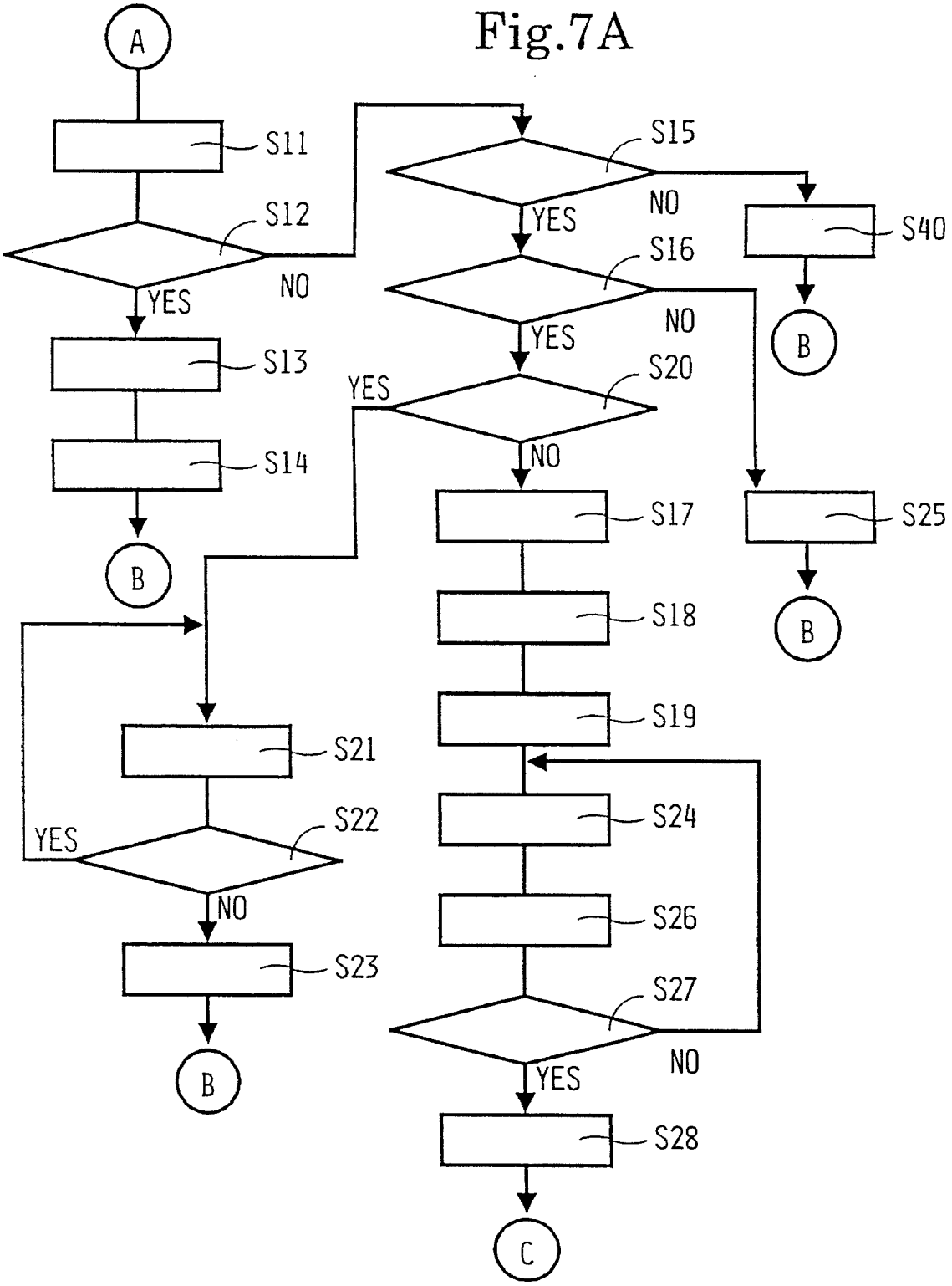
Figure 8:
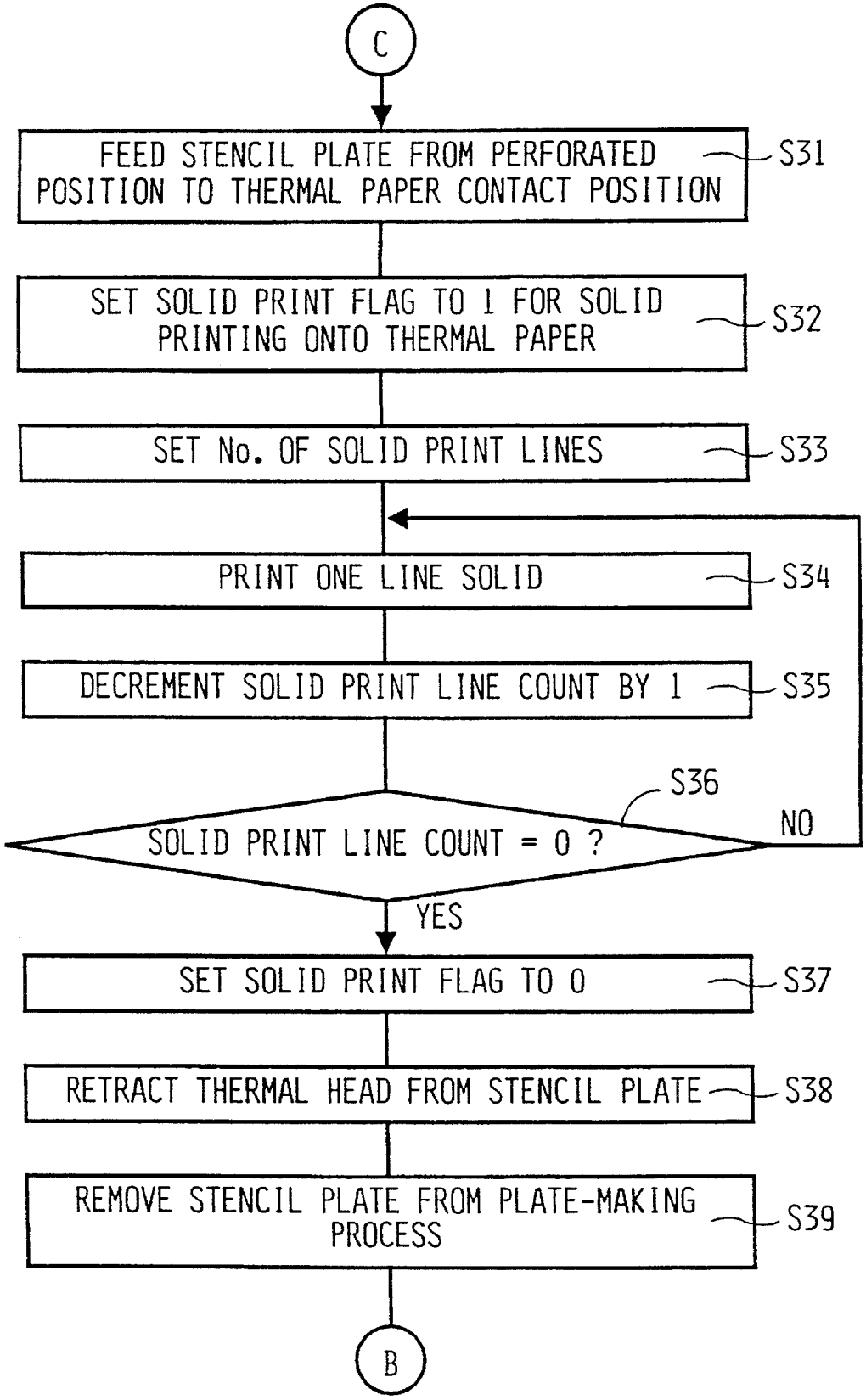
FIG. 8 is a flowchart of steps of a main program in the first embodiment.

The control of the stamp apparatus 12 in the first embodiment is described with reference to the flowcharts of FIGS. 6 through 8. In step I (S1) of FIG. 6 for initialization, the power backup unit 80 is started up, and the CPU 66 and its peripheral circuits are initialized. In step 2 (S2), control is in a loop until an ON flag is set to 1. The apparatus as a whole remains off. In this state, pressing the ON/OFF key 20 sets the ON flag to 1 by interruption. That in turn activates the peripheral circuits in step 3 (S3), whereby the entire apparatus is started. In step 4 (S4), a check is made to see if the ON flag is 0. If the ON flag is found to be I in step 4, step 11 (S11) of FIG. 7 is reached. Pushing the ON/OFF key 20, with power applied, sets the ON flag to 0 by interruption. With the ON flag found to be 0 in step 4, step 5 (S5) is reached in which the peripheral circuits are turned off and power is removed from the apparatus.

In step 11 of FIG. 7, the keys of the keyboard 16 are scanned. If any key is found to be operated, a check is made in step 12 (S12) to see if that key represents a character. If the operated key is a character key, step 13 (S13) is reached in which data input processing is performed. In step 14 (S14), the entered character is displayed on the LCD 18. Step 14 is followed by step 4 of FIG. 6.

If the operated key does not represent a character, a check is made in step 15 (S15) to determine whether the plate-making key 22 is pushed. If the plate-making key 22 is not pushed, the processing appropriate for the operated key is carried out in step 40 (S40).

If the plate-making key 22 is found to be pushed in step 15, a check is made in step 16 (S16) to determine whether the stencil plate 120 is set on the stamp apparatus 12. That is, whether the plate detecting switch 36 is turned on is determined. If the stencil plate 120 is not set, the plate detecting switch 36 is found to be off in step 16. In that case, step 16 is followed by step 25 (S25). In step 25, the LCD 18 displays an appropriate message (e.g., "Set stencil plate") to prompt the user to set the stencil plate 120 on the stamp apparatus 12. Step 25 is followed by step 4 of FIG. 6.

If the stencil plate 120 is found to be set in step 16, step 20 (S20) is reached. In step 20, a check is made to determine whether the thermal paper 136 is colored judging from the output of the reflective photo sensor 39. If the paper 136 is found to be colored, this connotes that the stencil plate 120 currently set on the stamp apparatus 12 has already been used. Thus, step 21 (S21) is reached in which the LCD 18 displays an alarm message such as "Plate already used" to warn the user. Steps 21 and 22 (S21 and S22) form a loop that is maintained until the already used stencil plate 120 is removed from the apparatus. Until the used stencil plate 120 is removed, the stamp apparatus 12 does not accept any request for processing. At this point, the plate-making process is completely disabled.

When the stencil plate 120 is found to be removed in step 22, the alarm display is canceled in step 23 (S23). Step 23 is followed by step 4 in which the next request for processing is awaited.

If the thermal paper 136 of the stencil plate 120 is not found to be colored in step 20, step 17 (S17) is reached. In step 17, the plate-making flag is set to 1, and the plate-making process is activated. In step 18 (S18), the number of lines to be perforated is set. In step 19 (S19), the thermal head 28 is pressed against the mounted stencil plate 120. In step 24 (S24), which follows step 19, one line is perforated on the stencil plate 120 according to the plate-making data representing the set number of lines to be perforated, and the stencil plate 120 is fed by one line. Step 24 is followed by step 26 (S26) in which the set number of lines is decremented by 1.

In step 27 (S27), a check is made to see if the number of lines to be perforated has reached 0. If the count 0 is yet to be reached, step 24 is reached again, and the plate-making process is carried out for another line (i.e., one line a time). When the set number of lines is found to have reached 0 in step 27, step 28 (S28) is reached. In step 28, the plate-making flag is set to 0. Step 28 is followed by step 31 (S31) of FIG. 8. In step 31, the stencil plate 120 is fed from its currently stopped position up to a position where the thermal paper 136 of the plate 120 comes into contact with the thermal head 28.

In step 32 (S32), the solid print flag is set to 1 for solid printing onto the thermal paper 136. The solid printing at this point connotes having the thermal paper 136 turned solid black by heat from the thermal head 28. In step 33 (S33), the number of lines to be printed solid onto the thermal paper 136 is set. The line count set in step 33 designates how many lines are to be colored on the thermal paper 136. The lines thus colored are so located that they are detected by the reflective photo sensor 39 when the stencil plate 120 is set on the stamp apparatus 12. Once the stencil plate 120 is perforated, its thermal paper 136 is colored solid black.

After one line is printed solid black in step 34, the stencil plate 120 is fed by one line and step 35 (S35) is reached. In step 35, the number of lines to be colored solid is decremented by 1. In step 36 (S36), a check is made to see if the set number of solid print lines has reached 0. If the count 0 is yet to be reached, step 34 (S34) is reached again, and one-line solid printing is repeated. When the solid print line count has reached 0 in step 36, step 37 (S37) is reached. In step 37, the solid print flag is set to 0. In step 38 (S38), the thermal head 28 is retracted from the stencil plate 120. Finally in step 39 (S39), the stencil plate 120 is removed and brought directly under the stamp member 140 of the stamp apparatus 12. This completes the plate-making process. Step 4 of FIG. 6 is then reached again and another request for the process is awaited.

As described, the first embodiment of the invention has its reflective photo sensor 39 detect the colored thermal paper 136 of an already used stencil plate 120 set on the stamp apparatus 12 and inhibits the plate-making process accordingly. If the user sets any used stencil plate 120 inadvertently on the stamp apparatus 12, the features of the invention prevent the plate from being used again. That in turn protects the thermal head 28 and the interior of the apparatus from getting soiled or damaged by spilled ink from the used stencil plate.

The second embodiment of the invention is described with reference to FIGS. 9 through 11. In describing the second embodiment, the parts having the same functions as their counterparts in the first embodiment are designated by the same reference numerals and any repetitive description thereof is omitted. Only the features that are different from those of the first embodiment are described.

Figure 9:
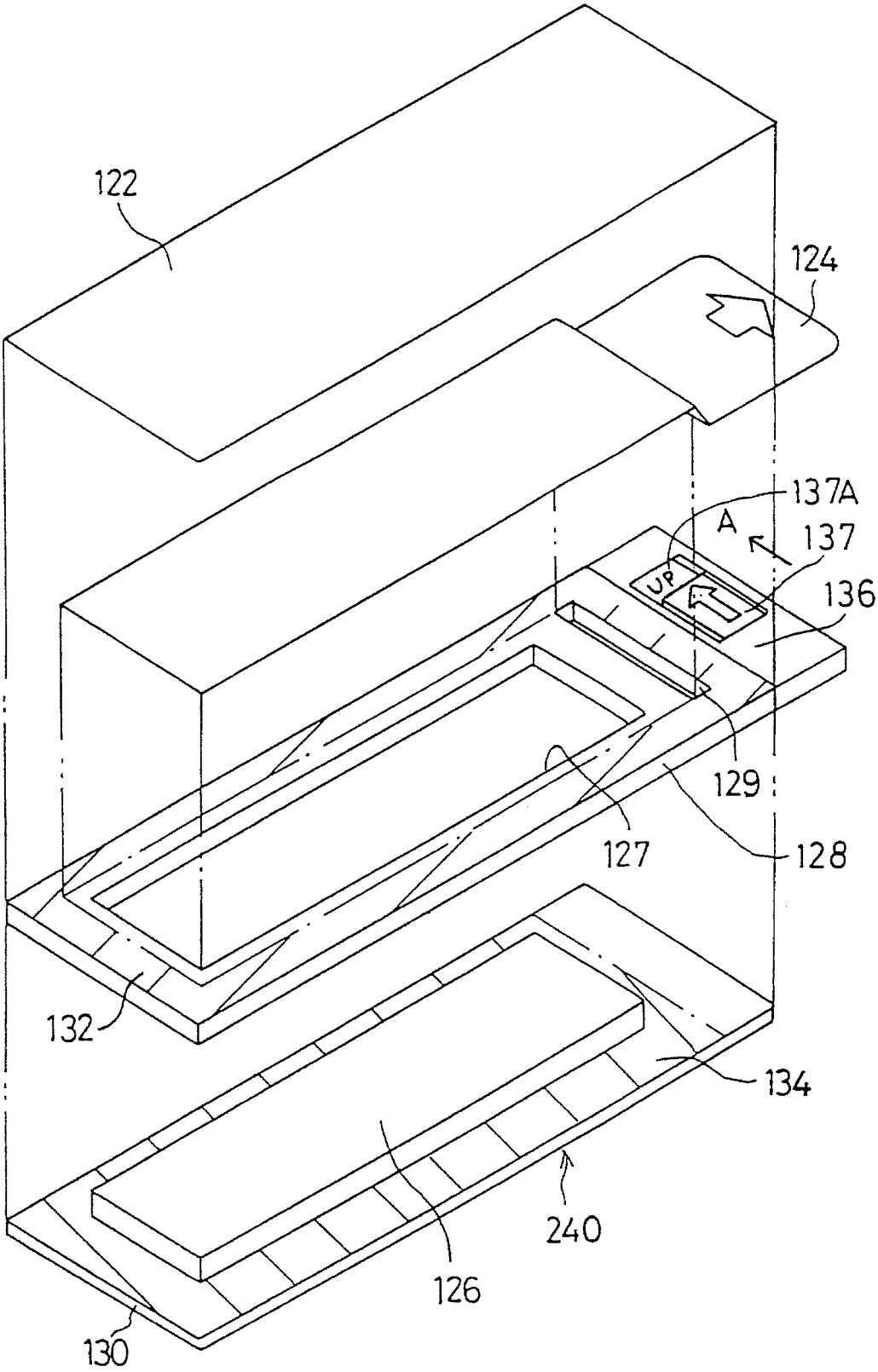
FIG. 9 is an exploded perspective view of a stencil plate in a second embodiment.

First to be described with reference to FIG. 9 is a stencil plate 240 for use with the second embodiment. The stencil plate 240 includes primarily thermal stencil paper 122, a separator 124, ink-impregnated non-woven fabric 126, a frame 128 with an opening 127 surrounding the non-woven fabric 126, and a film 130 that is an ink-impervious base material.

The structure of the frame 128 for the second embodiment is the same as that for the first embodiment except that the latter uses the thermal paper 136. In addition, the frame 128 for the second embodiment includes a projection 137 that is retractable in the direction perpendicular to the feed direction of the frame 128 (i.e., arrowed direction A in FIG. 9). FIG. 11 shows the projection 137 as it protrudes from the frame 128. On top of the projection 137 is a marking 137A indicating the orientation of the stencil plate (with the second embodiment, a marking "UP" indicates the top side of the stencil plate).

Figure 10:
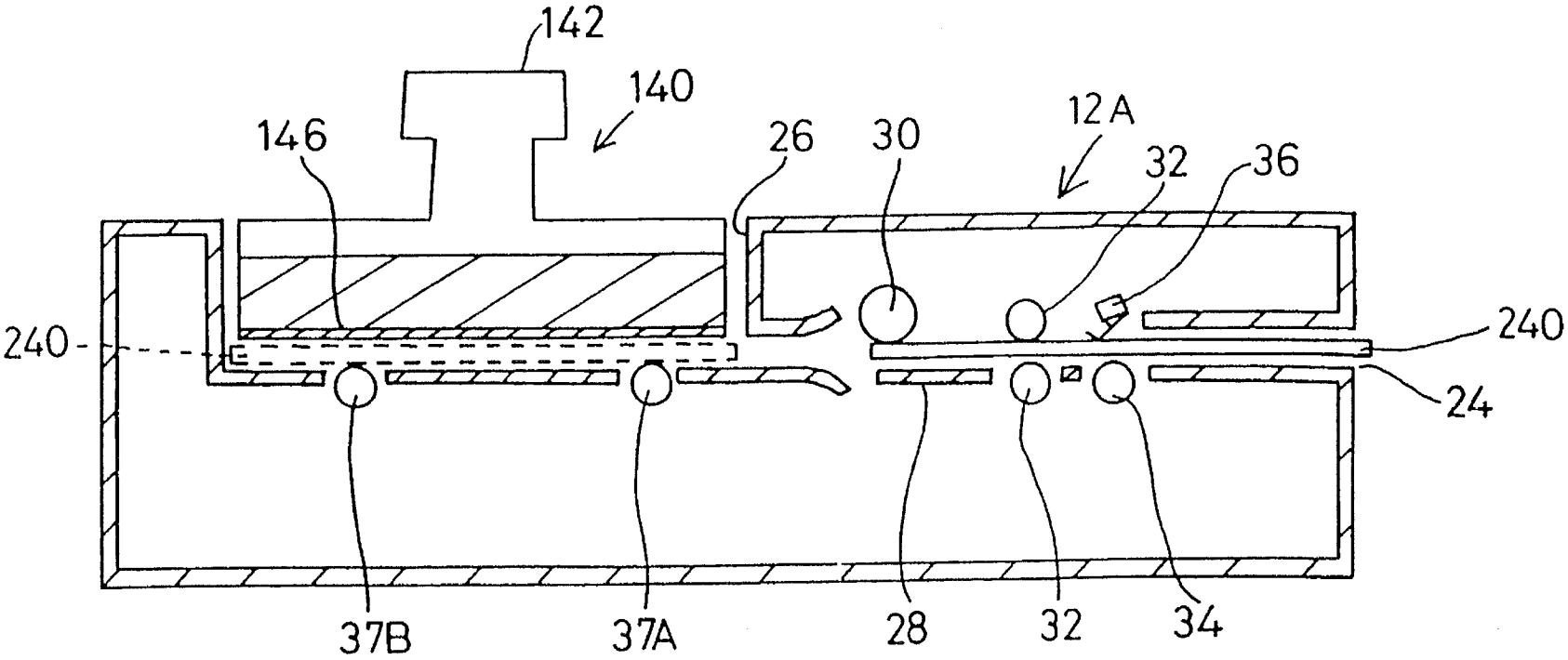
FIG. 10 is a cross-sectional schematic view of a plate-making mechanism in the second embodiment.
Figure 11:
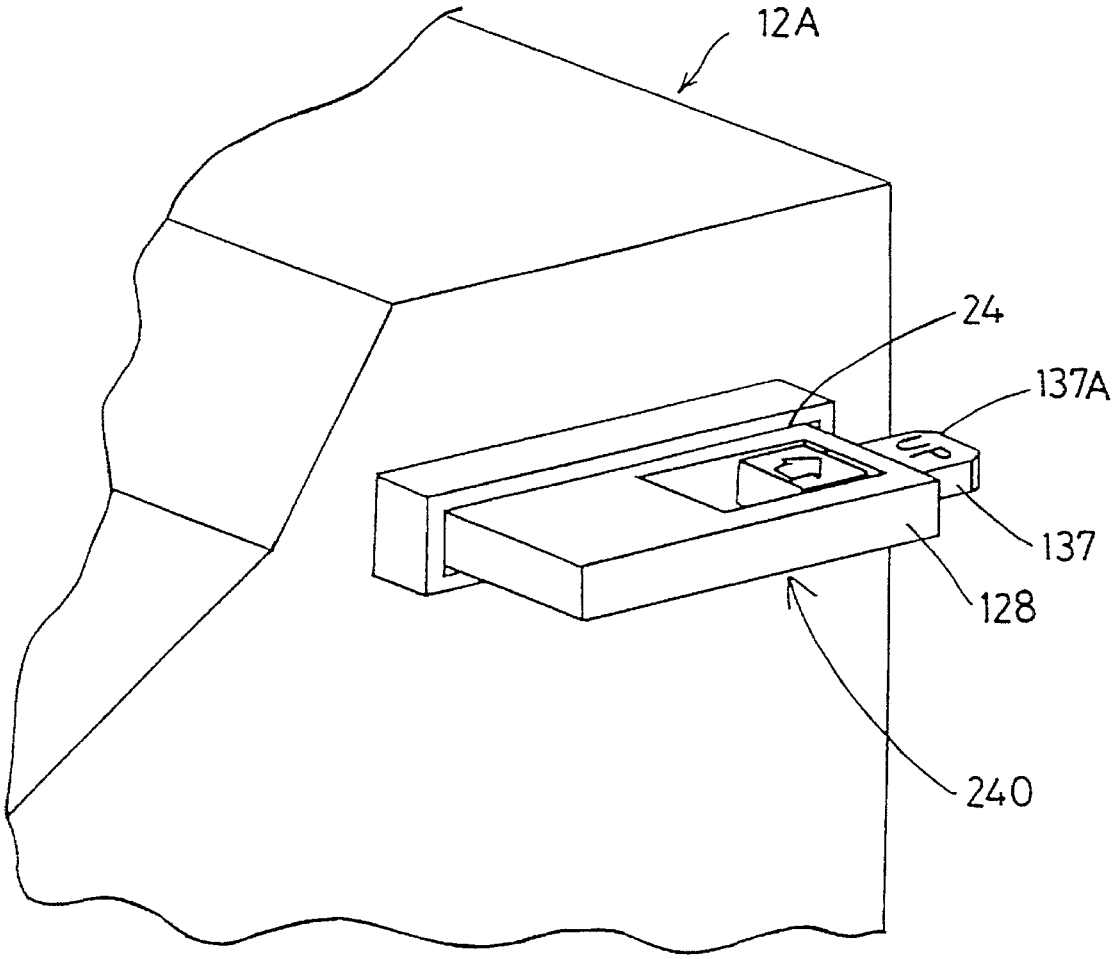
FIG. 11 is a partial perspective view of an inlet port and its surroundings of the plate-making mechanism in the second embodiment.

FIG. 10 is a cross-sectional view of a plate-making mechanism of a stamp apparatus 12A practiced as the second embodiment. The stamp apparatus 12A does not include a reflective photo sensor 39. The other components of the apparatus 12A are the same as those of the stamp apparatus 12 practiced as the first embodiment.

After the stencil plate 240 has been perforated by the stamp apparatus 12A, the user manually forces the projection 137 to protrude from the frame 128 in the arrowed direction A (FIG. 9). With the projection 137 thus protruding, the width of the used stencil plate 240 becomes greater than that of the inlet port 24 of the stamp apparatus 12A. This makes it impossible for the used stencil plate 240 to be inserted, however oriented, through the inlet port 24 and into position inside the stamp apparatus 12A.

As described, the protruding projection 137 prevents the already used stencil plate 240 from being inadvertently inserted by the user into the stamp apparatus 12A. Without the possibility of reusing used plates, the thermal head 28 and the interior of the apparatus are protected from being soiled or damaged by spilled ink from the used stencil plate. In addition, the marking 137A on the projection 137 clearly indicates the orientation of the stencil plate for use.

Although the description above contains many specificities, these should not be construed as limiting the scope of the invention but as merely providing illustrations of the presently preferred embodiments of this invention. For example, the keyboard used as the input device by the first and the second embodiments may be replaced by a personal computer or any other appropriate source that would supply characters and markings to the stamp apparatus through an input terminal. The reflective photo sensor used in the first embodiment as the means to detect the coloring of the thermal paper may be alternatively replaced by a solid-state image sensing device for image input.

Thus, the scope of the invention should be determined by the appended claims and their legal equivalents, rather than by the examples given.

What is claimed is:

1. A stencil device for use in a stamp apparatus comprising:

a stencil member for forming an image therein;

an ink carrier disposed adjacent to said stencil member; and a prior use indicator separate from and adjacent to said stencil member that indicates that an image has been formed in said stencil member and that prevents a subsequent image from being formed in said stencil member.

2. The stencil device of claim 1 wherein said prior use indicator comprises thermal paper that colors when an image is formed in said stencil member.

3. The stencil device of claim 2 wherein said stencil member is thermal stencil paper and said prior use indicator overlaps at least a portion of said thermal stencil paper.

4. The stencil device of claim 1 further comprising a removable separator disposed between said stencil member and said ink carrier.

5. The stencil device of claim further comprising a frame surrounding said ink carrier and supporting said stencil member, said prior use indicator being carried by said frame.

6. The stencil device of claim 5 wherein said prior use indicator is a retractable projection coupled to said frame.

7. The stencil device of claim 6 wherein said projection is retractable in a direction perpendicular to a feed direction of said frame into a stamp apparatus.

8. The stencil device of claim 1, wherein said prior use indicator is a movable member that is movable to a position that interferes with insertion of the stencil device in a stamp apparatus.

9. The stencil device of claim 1, wherein said prior use indicator is a thermally responsive member that changes state when an image is formed in said stencil member.

10. A stamp apparatus for making a stencil plate comprising:

a feed path including an inlet port for inserting a stencil plate therein;

a detector disposed in said feed path for detecting prior use of an inserted stencil plate;

a warning device coupled to said detector for warning of insertion of a used stencil plate;

an image making device disposed in said feed path for making an image on an inserted stencil plate; and a controller coupled to said detector, said warning device and said image making device for controlling said warning device and said image making device when a used stencil plate is detected.

11. The stamp apparatus of claim 10 wherein said detector comprises a reflective photo sensor that determines when a stencil plate is used.

12. The stamp apparatus of claim 10 wherein said detector comprises an image sensor that determines when a stencil plate is used.

13. The stamp apparatus of claim 10 further comprising a disabling device coupled to said controller for disabling said image making device when a used stencil plate is detected.

14. The stamp apparatus of claim 10 wherein said image making device is a thermal head that perforates the inserted stencil plate according to the image.

15. A stamp apparatus and a stencil plate for use therewith, wherein said stamp apparatus comprises:

an inlet port for inserting said stencil plate therein;

an image making device accessed through said inlet port for making an image on said inserted stencil plate; and wherein said stencil plate comprises:

a stencil member for forming an image therein;

an ink carrier disposed adjacent to said stencil member; and a prior use indicator separate from and adjacent to said stencil member that indicates that an image has been formed in said stencil member and that disables said image making device to prevent a subsequent image from being formed in said stencil member.

16. The combination of claim 15 further comprising a detector accessed through said inlet port for detecting that an image has been formed in said stencil member of said inserted stencil plate.

17. The combination of claim 16 further comprising a warning device coupled to said detector for warning of insertion of a used stencil plate.

18. The combination of claim 17 further comprising a controller coupled to said detector, said warning device and said image making device for controlling said warning device and said image making device when a used stencil plate is detected.

19. The combination of claim 16 wherein said image making device comprises a thermal head that perforates the inserted stencil plate according to the image, said prior use indicator comprises thermal paper disposed adjacent said stencil member that colors when an image is formed in said stencil member and said detector comprises a reflective photo sensor that senses when said thermal paper is colored.

20. The combination of claim 15 further comprising a frame surrounding said ink carrier and supporting said stencil member, said prior use indicator being carried by said frame.

21. The combination of claim 20 wherein said prior use indicator is a retractable projection on said frame that interferes with said inlet port when said stencil plate is used.

22. The combination of claim 15 further comprising an input for inputting data concerning an image to be formed on said stencil plate.

23. The combination of claim 15 wherein said prior use indicator is a movable member movable between a first position that allows insertion of said stencil plate in said stamp apparatus and a second position that prevents insertion of said stencil plate in said stamp apparatus.

24. The combination of claim 15 further comprising a detector in said stamp apparatus that detects said prior use indicator and outputs a disabling signal to said image making device.

25. A stamp device for use in a stamp apparatus, comprising:

a stencil member for forming an image therein;

an ink carrier disposed adjacent to said stencil member;

a support member that supports said stencil member and said ink carrier; and an indicator disposed on said support member separate from said stencil member that indicates one of a used state of said stencil member in which an image has been formed therein and an unused state of said stencil member in which an image has not yet been formed therein.

26. The stamp device of claim 25, wherein said support member is a frame.

27. The stamp device of claim 25, wherein said indicator is a movable member movable between a first position that allows insertion of said stamp device in a stamp apparatus and a second position that prevents insertion of said stamp device in a stamp apparatus.

28. The stamp device of claim 25, wherein said indicator is a thermal sensitive member that colors when an image is formed in said stencil member.

* * * * *